US005927708A

United States Patent [19]

Baldino et al.

[11] Patent Number: 5,927,708

[45] Date of Patent: Jul. 27, 1999

[54] ADJUSTABLE SIDE GUIDE FOR MAIL PROCESSING MACHINES

[75] Inventors: Neil F. Baldino, Sandy Hook; Pushpavadan S. Nagarsheth, Danbury, both of Conn.

[73] Assignee: Pitney Bowes Inc., Stamford, Conn.

[21] Appl. No.: 08/994,853

[22] Filed: Dec. 19, 1997

[51] Int. Cl.[6] ..... B65H 1/08; B65H 3/52; B65H 1/00

[52] U.S. Cl. ..... 271/171; 271/126; 271/238

[58] Field of Search ..... 271/171, 126, 271/238

[56] References Cited

U.S. PATENT DOCUMENTS

| | | | |
|---|---|---|---|
| 4,348,249 | 9/1982 | Denzin | 156/442.2 |
| 4,887,807 | 12/1989 | Berger et al. | 271/171 |
| 4,973,037 | 11/1990 | Holbrook | 271/2 |
| 5,112,037 | 5/1992 | Holbrook | 271/2 |
| 5,209,467 | 5/1993 | Schmaling | 271/240 |
| 5,263,699 | 11/1993 | Selak et al. | 271/15 |
| 5,350,165 | 9/1994 | Nagamoto | 271/9 |
| 5,628,504 | 5/1997 | Lyga | 271/171 |
| 5,632,477 | 5/1997 | Morinaga | 271/127 |
| 5,772,199 | 6/1998 | Green | 271/10.06 |

*Primary Examiner*—William E. Terrell
*Assistant Examiner*—Ku Bower
*Attorney, Agent, or Firm*—Angelo N. Chaclas; Melvin J. Scolnick

[57] ABSTRACT

An envelope side guide for a mailing machine includes an elongate support means which is formed to be extendable and retractable in a telescopic manner is connected at one end to a portion of the frame of the mailing machine and supports an envelope guide means on the other end. In one embodiment of the invention, the support means is rigidly connected to the mailing machine frame, and the guide means is mounted so as to be vertically movable on the other end of the support means so that it can be raised above the feed deck of the mailing machine to permit oversized envelopes to be fed into the mailing machine. In another embodiment of the invention, the support means is pivotally connected to the mailing machine frame and the guide means is rigidly connected to the other end of the support means so that the guide means can be raised merely by pivoting the entire side guide assembly upwardly.

6 Claims, 4 Drawing Sheets

FIG. 5
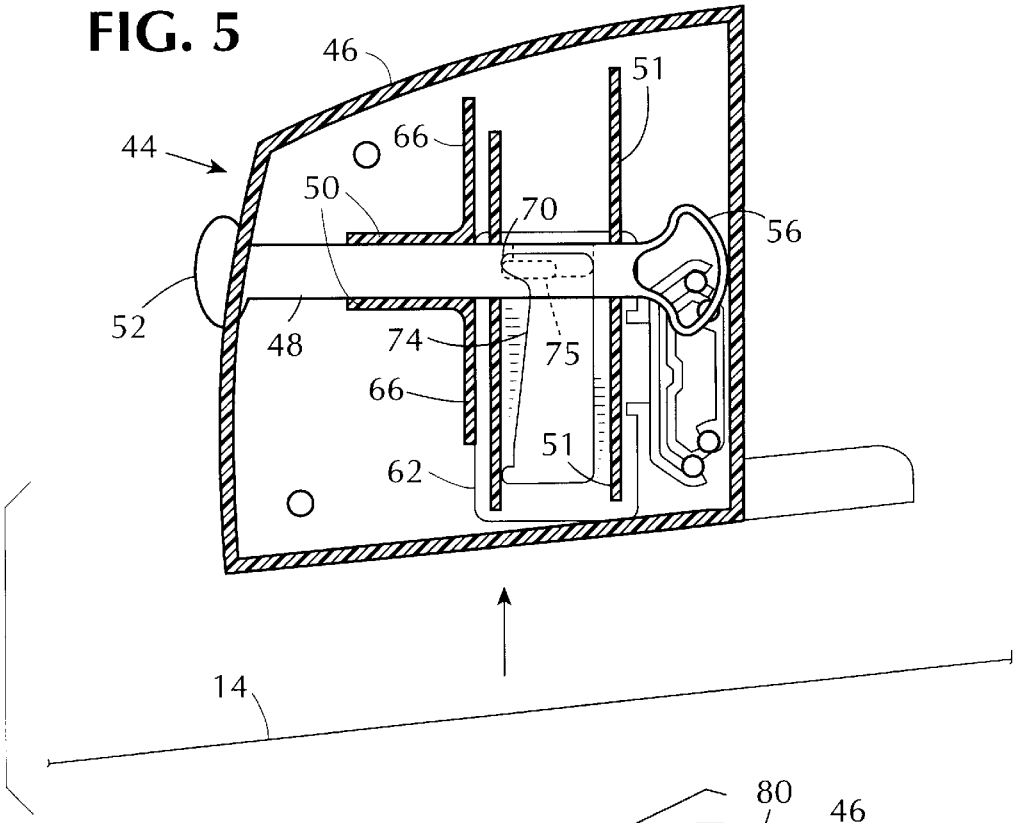
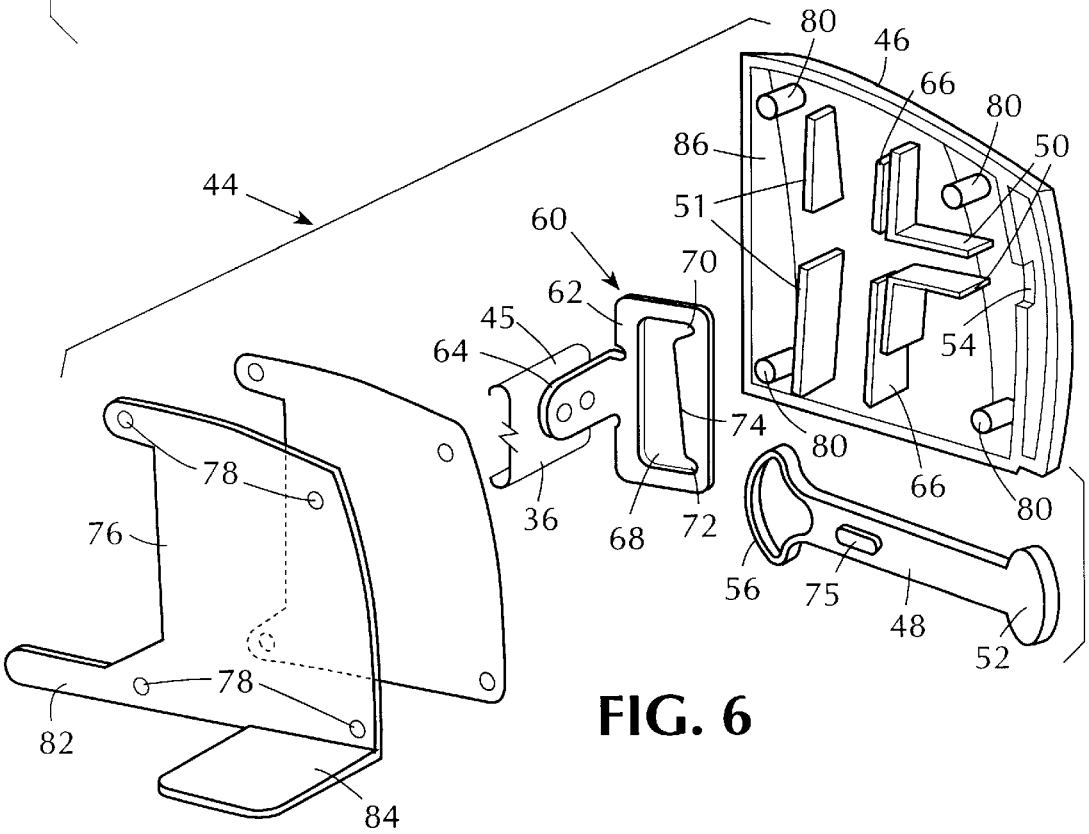
FIG. 6

ADJUSTABLE SIDE GUIDE FOR MAIL PROCESSING MACHINES

BACKGROUND OF THE INVENTION

This invention relates generally to the field of mail processing machines, and more particularly to mailing machines having automatic mail feeding devices which feed mail seriatim from a stack for processing in the mailing machine.

Mail processing machines of the type to which the present invention relates have long been well known and have achieved widespread commercial success. Although there are numerous variations of mailing machines available, the device of the present invention is particularly adapted for use with mailing machines which are designed to handle large quantities of mail at a high rate of speed, and thus are used particularly by medium to high volume mailers, such as commercial institutions having monthly mailings to large numbers of customers, i.e., banks, utilities, insurance companies, catalog sales companies, etc.

Mailing machines of the type to which the present invention relates typically include an elongated feed deck along which mail pieces of the same or varying size are fed by a suitable feeding mechanism past a plurality of processing components. Typically, a suitable hopper for holding a stack of mail pieces is situated on the feed deck at the inlet end of the machine, and a plurality of nudger rollers projecting upwardly through the feed deck urge the bottom mail piece into a separating or singulating device which ensures that only one mail piece at a time is fed into the mailing machine. An envelope flap moistening, closing and sealing device is situated adjacent to the separating device for moistening the gummed surface of the envelope flaps and for closing and sealing them to the rear panel of the envelopes. A postage meter having a suitable printing device is situated adjacent to the flap closing and sealing device for printing a postage indicia on the mail pieces, after which they are fed to a suitable stacking device where they are prepared for mailing. In more sophisticated mailing machines, a scale is interposed along the feed deck between the envelope flap closing and sealing device and the postage meter so as to weigh the mail pieces as they pass along the feed deck, thereby enabling the postage meter to print and appropriate amount of postage depending on the weight of the mail piece.

Mailing machines of the type described above are typically technologically sophisticated machines, involving a variety of complex mechanical devices and mechanisms, as well as complex computerized electronic control device, all under the control of appropriate software. As such, these machines are relatively costly to obtain and maintain, with the result that they are cost effective to own and operate only if the operator generates a substantially large volume of mail, and the machine is maintained in operation for substantially long periods of time. It is apparent that any type of circumstance that suddenly prevents the mailing machine from operating properly and results in down time for service, repair or jam clearing, results in a reduction in the cost effectiveness of the machine, and ultimately may result in the machine no longer being commercially viable. Also, they are generally cost effective only if they can handle a variety of sizes of mail pieces, typically ranging from standard post cards to envelopes up to 14 inches in width.

In order for these mailing machines to function properly, it is essential that the mail pieces be fed into the machine in a precise orientation with respect to the longitudinal axis of the machine. If the mail pieces are not fed in the proper orientation consistently, the flap closing and sealing device may not function properly, the weighing device may give an incorrect weight and the postage meter may not print the postage indicia in the prescribed location on the envelope. To ensure that the envelopes are fed in the proper feeding orientation, mailing machines are typically provided with a registration wall against which the top edges of the mail pieces are urged by the feeding mechanism when they are first separated from the stack and fed into the separating device. However, even if all of the envelopes in the stack are properly aligned and the stack is initially placed in the hopper of the feeding mechanism properly, there is still a possibility that envelopes can be skewed relative to the longitudinal axis of the mailing machine by the nudging and separating rollers as the envelope is extracted from beneath the stack and fed onto the feed deck. This tendency for envelopes to skew during separation and initial feeding becomes more pronounced as the width of envelopes in the stack increases, due to the nature of the placement of the separating and feeding rollers on the deck of the mailing machine.

This problem has been partially overcome in prior art mailing machines by the provision of a variety of side guides built into the mailing machine which abut the forward edges of the envelopes in the stack so as to prevent the bottom envelopes from skewing when they are separated from the stack. The problems that have arisen with the prior art side guides is that they are not sufficiently adjustable to handle the range of envelopes typically encountered by mailing machines of the type described above, that they are awkward or difficult to manipulate when changing from a stack of one size of envelope to a stack of another size, that they are relatively complex in construction and therefore unduly costly to add to a mailing machine that is already costly, and that the nature of the design and construction often tends to interfere with easy and rapid placement of a stack of envelope in the hopper of the feeding mechanism.

Thus, as the speed, volume and envelope size capacity of mailing machines increases, there is more and more of a demand for a very simple and inexpensive, highly effective and easy to manipulate envelope side for such mailing machines.

BRIEF SUMMARY OF THE INVENTION

The present invention substantially alleviates if not entirely eliminates the foregoing problems of prior art envelope side guides for mailing machines by providing a side guide that has a range of adjustability that will accommodate the full range of envelopes normally encountered in mass mailings, is very easy to manipulate when changing envelope size, is very simple in construction and consequently inexpensive and does not in any manner interfere with normal operator handling of the mailing machine.

In its broader aspects, the mailing machine side guide of the present invention is designed to be used in combination with a mailing machine having a hopper for holding a stack of envelopes to be fed through and processed in the mailing machine, a feed deck for supporting the stack, a feeding means mounted in the feed deck for separating the bottom envelope of the stack and feeding the envelope into the mailing machine, and a registration wall against which the feeding means urges the top edge of the bottom envelope during the separating and feeding thereof. Within this environment, the invention is an envelope side guide for engaging the lower edge of the envelope during the separating and feeding thereof and for maintaining proper alignment of the envelopes during the separating and feeding, and comprises an elongate support means having one end thereof mounted on the mailing machine adjacent the registration wall and in overlying relationship with the feed deck, means permitting the support means to be manually extendable and retractable in a direction substantially perpendicular to the direction of feed of envelopes along the feed deck, guide means mounted on the support means adjacent the end thereof opposite to the end thereof that is mounted on the mailing machine, and means permitting the guide means to be moved from a first position in which the guide means is substantially resting on the feed deck adjacent the lower edge of the bottom envelope and a second position in which the guide means is spaced above the feed deck a distance sufficient to permit an oversized envelope to pass beneath the guide means, whereby the side guide prevents envelopes from skewing out of the proper orientation for feeding through the mailing machine.

In some of its more limited aspects, the support means is formed as a plurality of individual support elements which are formed to fit telescopically within one another, with the innermost element connected to the mailing machine frame and the guide means mounted on the outermost element. In one embodiment of the invention, the inner end of the innermost support element of the support means is rigidly connected to the mailing machine frame, and the guide means is connected to the outer end of the outermost support element by means permitting limited vertical movement of the guide means. This means comprises a bracket connected to the outermost support element, and a latching mechanism slidably connecting the guide means to the bracket which permits the guide means to be moved vertically and locked in a first position with the guide means resting on the feed deck and in a second position in which the guide means is spaced above the feed deck. In another embodiment of the invention, the innermost support element is pivotally connected to the mailing machine frame and the guide means is fixed on the outer end of the outermost support element and is raised above the feed deck merely by pivoting the entire support means about the pivotal connection thereof with the mailing machine frame.

Having briefly described the general nature of the present invention, it is a principal object thereof to provide a new and improved envelope side guide for a mailing machine which will prevent envelopes from being skewed out of proper feeding orientation when they are initially fed into the mailing machine.

Another object of the present invention is to provide an envelope side guide for a mailing machine which will accommodate a wide range of envelope sizes, is easy to manipulate by the operator of the mailing machine, does not interfere in any manner with normal operation of the mailing machine, and is relatively inexpensive.

These and other objects and advantages of the present invention will be more apparent from an understanding of the following detailed description of the presently preferred modes of carrying out the principles of the present invention, when considered in conjunction with the accompanying drawings.

DESCRIPTION OF THE DRAWINGS

FIG. 5 is a view similar to FIG. 3 showing the position of the parts of the latching mechanism when the side guide is in the raised position.

FIG. 6 is a perspective exploded view of the parts of the latching mechanism of the side guide.

DETAILED DESCRIPTION OF THE INVENTION

Figure 1:
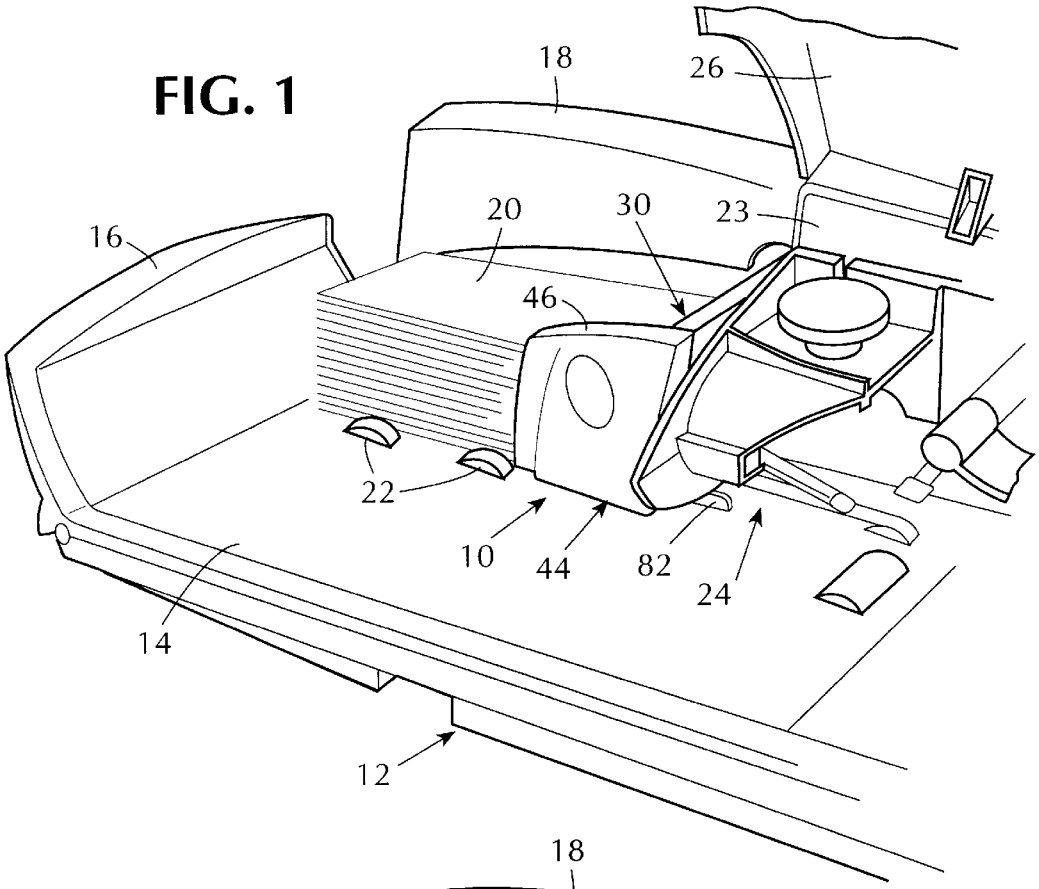
FIG. 1 is a perspective view of the infeed end of a typical mailing machine of the type with which the present invention is intended for use, showing one embodiment of the side guide in an inner position with mail pieces of a small size within the range of envelope sizes that the side guide can accommodate.

Referring now to the drawings, and more particularly to FIG. 1 thereof, the envelope side guide of the present invention, designated generally by the reference numeral 10, is illustratively shown as embodied in a mailing machine, designated generally by the reference numeral 12. The mailing machine 12 includes a generally flat, elongate feed deck 14, and an end wall 16 and a rear tamper wall 18 which combine to form a hopper for receiving and storing a stack 20 of envelopes which are to be processed in the mailing machine 12. A plurality of sets of nudger rollers 22 (See also FIG. 7) are suitably mounted beneath the feed deck 14 and project through openings in the feed deck 14 so as to contact the bottom envelope of the stack 20 and feed it into the mailing machine 12. A registration wall 23 is mounted on the mailing machine 12 and extends generally from the wall 18 of the hopper substantially through the length of the mailing machine 12, the registration wall serving as a guide surface against which the upper edges of envelopes are urged to ensure that the envelopes are maintained in a proper orientation as they are fed through the mailing machine 12.

Figure 7:
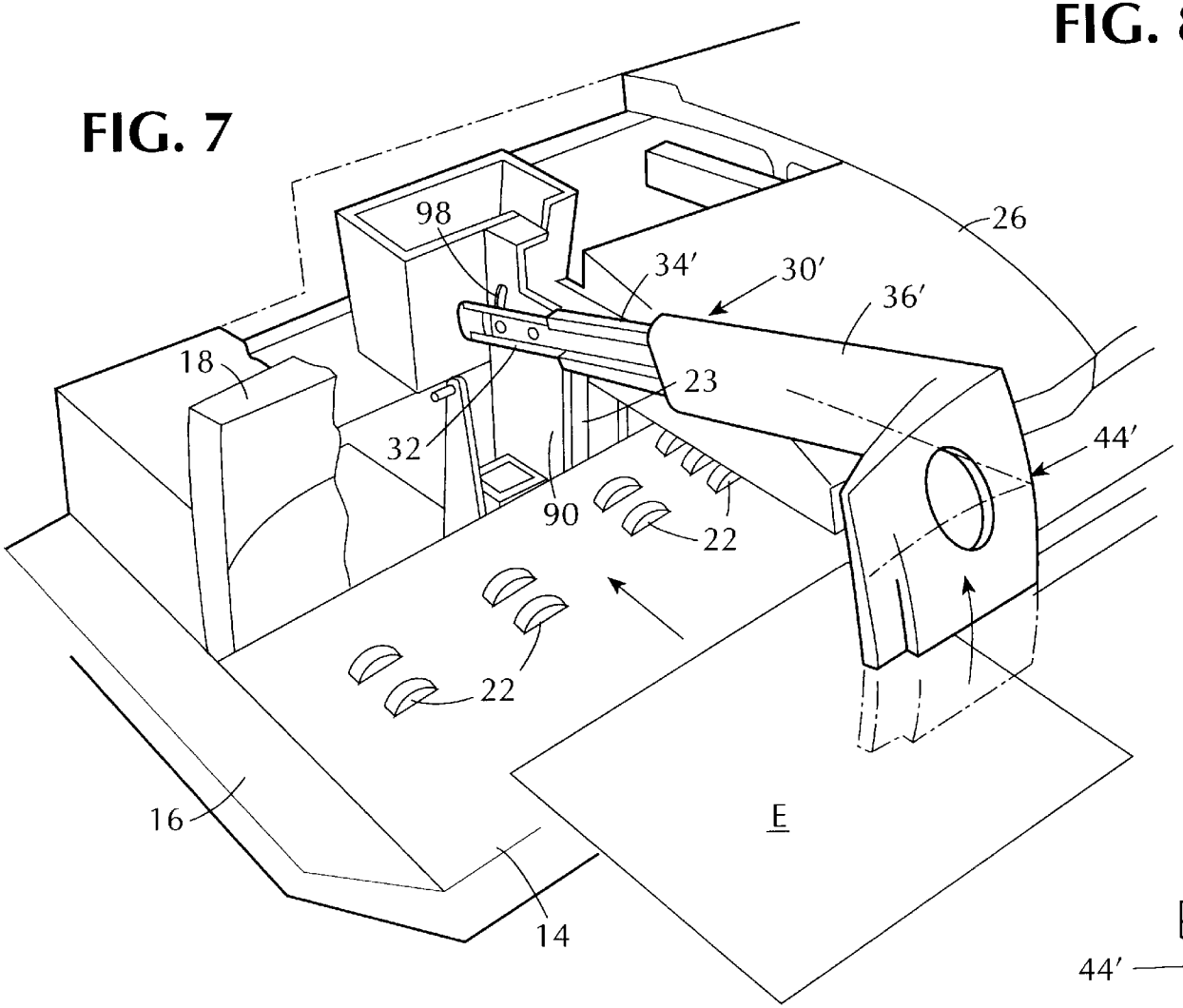
FIG. 7 is a view similar to FIG. 1 but looking in the opposite direction and showing another embodiment of the side guide.

A suitable separating device, designated generally by the reference numeral 24, is suitably mounted on a portion of the mailing machine 12 adjacent to the envelope side guide 10 and the forward end of the stack 20 of envelopes, and is normally covered by the cover 26, as best seen in FIG. 7. The function of the separating device 24 is to ensure that only one envelope at a time is separated from the bottom of the stack 20 by the nudger rollers 22 and fed into the mailing machine 12, and since devices of this type are well known in the art, further description and illustration thereof is not deemed necessary for an understanding of the invention.

It will be understood that the mailing machine 12 is of the type that operates at a relatively high rate of speed, typically in the order of 160 to 210 mail pieces per minute, and therefore is a relatively complex and costly machine which is typically used by medium to very high volume mailers. The mailing machine 12 therefore includes various processing instrumentalities, such as an envelope flap closing and sealing device, a weighing scale, and a postage meter including a postage printing device for printing postage indicia either directly on envelopes or on tape which is affixed to envelopes too bulky to feed through the mailing machine. Since none of these instrumentalities form any part of the present invention, further illustration or description thereof is not deemed necessary.

Figure 3:
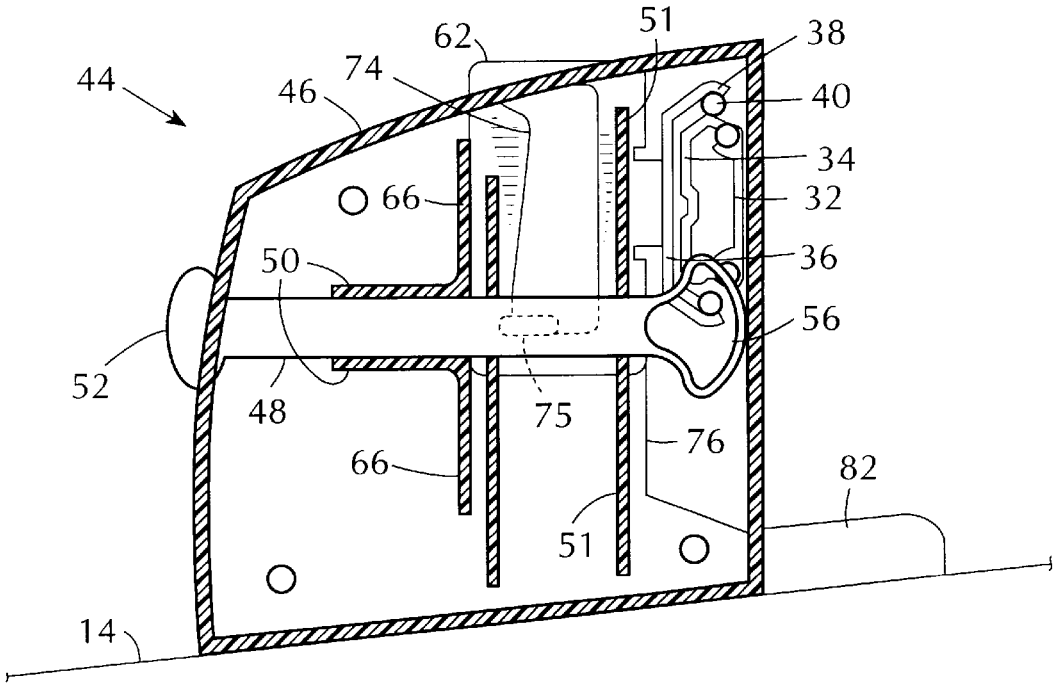
FIG. 3 is a side sectional view through the side guide showing the latching mechanism for latching the side guide in the lower and upper positions.

The envelope side guide 10 of the present invention comprises an elongate support means 30 which is mounted on the mailing machine 12, as more fully explained below, adjacent the registration wall 23 and in overlying relationship with the feed deck 14. The support means 30 includes means permitting it to be manually extendable and retractable in a direction substantially perpendicular to the direction of feed of envelopes along the feed deck 14. In the preferred form of the invention, this means comprises a plurality of individual support elements 32, 34 and 36, which are formed as channels having overlapping portions 38 with roller bearing 40 interposed therebetween (FIG. 3).

Figure 2:
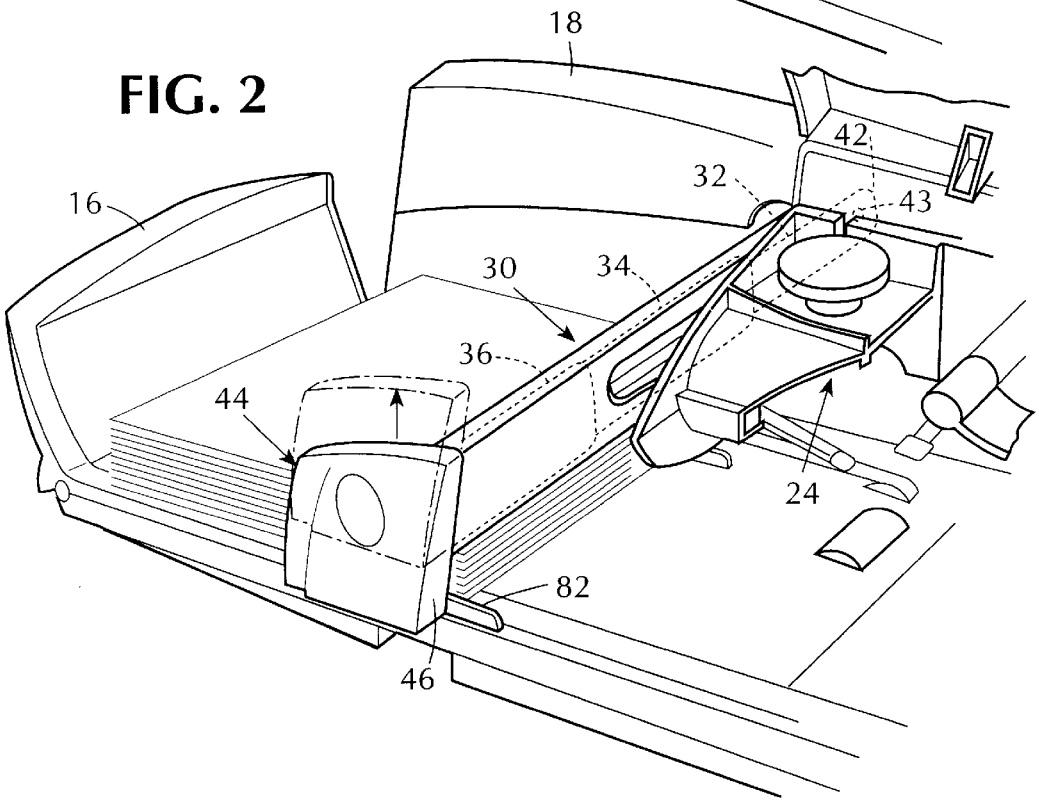
FIG. 2 is a view similar to FIG. 1 but showing the side guide extended to the maximum limit of mail size that the side guide can accommodate, and showing the side guide both in the lower position in solid lines and in the raised position in phantom lines.

With reference to FIGS. 3 through 6, in one embodiment of the preferred form, the inner end 42 of the innermost support element 32 is suitably rigidly connected to the mailing machine adjacent the registration wall as indicated by the bolt 43, and the envelope side guide includes a guide means, designated generally by the reference numeral 44 in FIGS. 1 and 2, is mounted on the support means 30 adjacent the outer end 45 (FIG. 6) of the outermost support element 36 opposite to the end 42 that is mounted on the mailing machine 12 in a manner fully described below. The guide means 44 comprises a generally rectangular housing 46, which encloses a means for permitting limited vertical movement of the guide means 44 to be moved from a first position in which the guide means 44 is substantially resting on the feed deck 14 adjacent the lower edge of the bottom envelope, and a second position in which the guide means 44 is spaced above the feed deck a distance sufficient to permit an oversized envelope to pass beneath the guide means 44.

Thus, an elongate latching element 48, and suitable upper and lower guide means 50 and 51, are mounted within the housing 46 for guiding the latching element 48 for limited horizontal movement within the housing. One end 52 of the latching element 48 projects through an opening 54 in the side of the housing so as to be accessible to an operator, and the other end 56 of the latching element 48 is formed as a resilient end wall which depresses inwardly from the position shown in FIG. 3 to the position shown in FIG. 4 when the latching element 48 is moved in the direction of the arrow 58 shown in FIG. 4.

The means for permitting limited vertical movement of the guide means 44 also comprises a mounting bracket, designated generally by the reference numeral 60 in FIG. 6, the mounting bracket 60 having a generally flat rectangular plate 62 and a mounting tab 64 connected to the plate 62 at a 90° angle, the mounting tab 64 in turn being suitably connected to the outer end 45 of the outermost support element 36. The plate 62 is captured in the housing 46 by being disposed behind the latching member element 48 within the vertical space defined by the guide means 51 and oppositely facing upper and lower guide means 66. The plate 62 is provided with an elongate vertically extending aperture 68 having a pair of vertically spaced apart latching means which, in the embodiment disclosed, is a pair of latching detents 70 and 72, and the side wall 74 of the aperture 68 adjacent the latching detents 70 and 72 is slanted outwardly from the upper latching detent 70 to the lower locking detent 72. The latching element 48 has an laterally protruding boss 75 which forms a latching means to maintain the guide means 44 in the aforementioned first and second positions.

The guide means 44 further includes a guide plate 76 having approximately the same configuration as the housing 46, and is suitably secured thereto as by screws passing through the apertures 78 and into mounting studs 80 connected to the inner wall of the housing 44. The guide plate 76 includes a forwardly facing finger 82 which serves to extend the effective length of the guide plate 76 beyond that afforded by the main body of the plate 76 in the direction of feed of the bottom envelope of the stack 20. The guide plate 76 also includes a bottom tab 84 connected to the lower edge of the guide plate 76 and projecting outwardly therefrom in the direction of the registration wall 23 so as to ensure that the bottom envelope of the stack cannot ride under the lower edge of the guide means 44 even though it is resting on the feed deck 14.

The operation of the guide means 44 is as follows. FIG. 3 illustrates the position of the guide means 44 when it is in the first position in which the guide plate 76 is resting on the feed deck 14. The guide means 44 is moved inwardly and outwardly merely by manually pushing or pulling on the guide means 44, during which the support elements 32. 34 and 36 extend or retract telescopically. The guide means 44 is moved to a position in which the guide plate 76 lightly bears against the forward edges of the envelopes in the stack 20.

Figure 4:
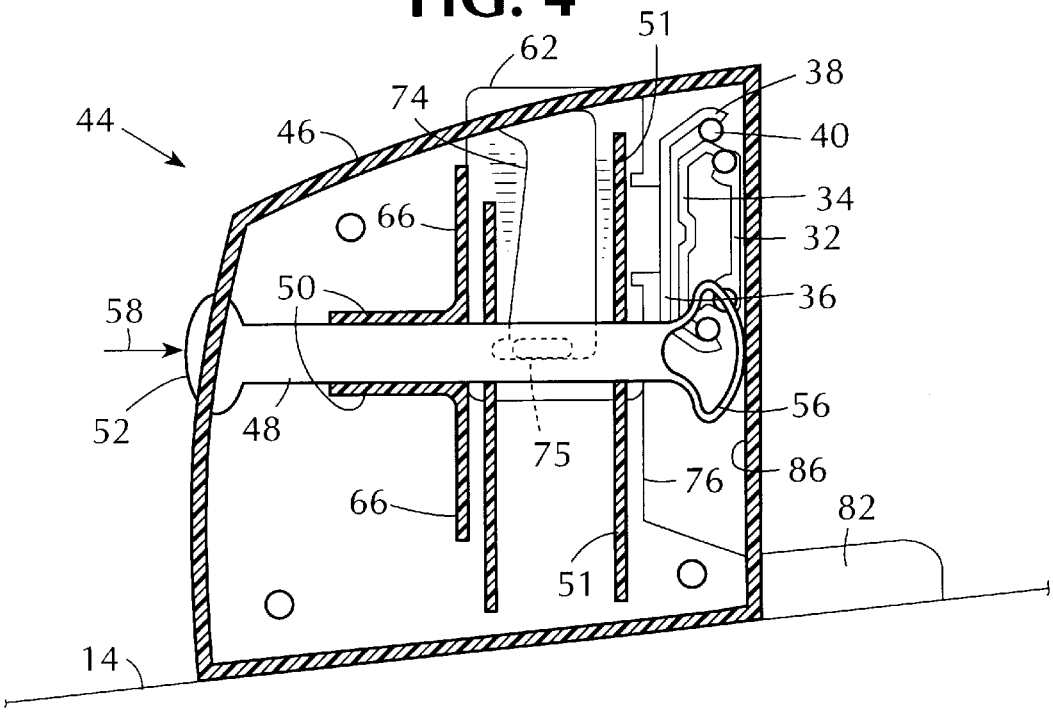
FIG. 4 is a view similar to FIG. 3 showing the latching element in an unlocked position.

If it is desired to feed envelopes into the mailing machine 12 that are wider than the maximum distance to which the guide means 44 can be spaced from the registration wall 23, the guide means 44 is moved from the first position to the second position shown in FIG. 5 and in dotted lines in FIG. 2, in which the guide means 44 is raised above the feed deck 14. This is accomplished by the operator pushing on the extended end 52 of the latching element 48 to slightly compress the resilient end 56 of the latching element 48 against the interior end surface 86 of the housing 46, thereby disengaging the latching boss 75 from the lower latching detent 72 of the bracket plate 62, as shown in FIG. 4. The operator then raises the guide means 44 relative to the mounting bracket 60 until the guide mean 44 reaches the second position, at which the latching boss 75 will enter the upper latching detent 70 to latch the guide means 44 in the second position. During this movement, the latching boss 75 slides along the slanted surface 74 of the plate 62 to slightly increase the compression of the resilient end 56 of the latching element 48 so that the latching boss 75 is firmly seated in the latching detent 70 to ensure that the guide means 44 cannot inadvertently drop back to the first position while an oversized envelope is being fed beneath the guide means 44. To return the guide means 44 to the first position, the operator again presses on the outer end 52 of the latching element 48 to disengage the latching boss 75 from the upper latching detent 70 to permit the guide means 44 to lower to the first position, at which the latching boss 75 will reengage with the lower latching detent 72.

Figure 8:
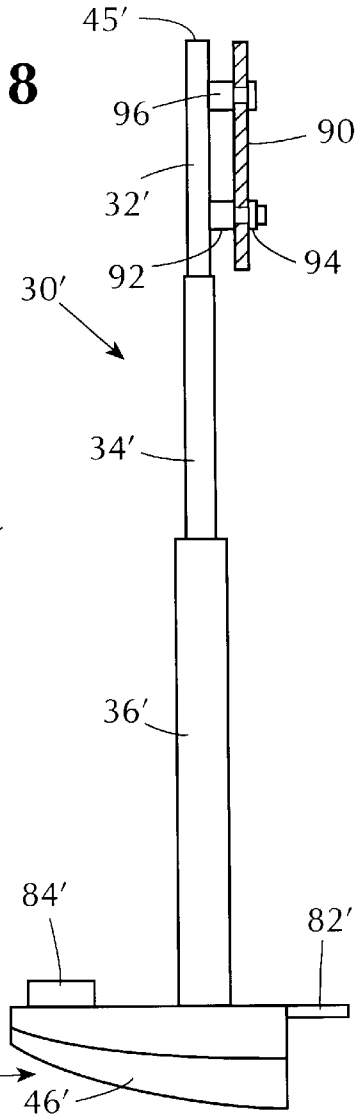
FIG. 8 is a plan view of the support means for the side guide of the second embodiment.

FIGS. 7 and 8 illustrate another embodiment of the invention which is a simpler and therefore less costly construction than that illustrated in FIGS. 1 through 6 and described above. In this embodiment, the inner end of the elongated support means 30' is pivotally connected to the mailing machine frame rather than fixedly connected as in the previous embodiment, and the guide means 44' is fixedly connected to the outer end of the outermost support element 36' of the support means 30' rather than movably connected as in the previous embodiment, with the result that the guide means 44' is raised and lowered by pivotally moving the support means 30' about the pivotal connection.

Thus, it will be seen that the inner support element 32' is suitably pivotally connected to a convenient portion 90 of the mailing machine frame adjacent to but slightly spaced from the inner end 45' of the support element 32' as by a stub shaft 92 mounted on the support element 32' which passes through an aperture in the frame portion 90 of the mailing machine 12, and is secured thereto by a nut 94 or other suitable retainer. Another stub shaft 96 is mounted on the support element 32' in spaced relationship with the stub shaft 92 and closer to the end 45' of the support element 32', the stub shaft 96 passing through an arcuate slot 98 formed in the frame portion 90. The length of the arcuate slot 98 is adjusted to limit the upward movement of the outer end of the support means 30' and the guide means 44' mounted thereon so as to prevent this structure from interfering with opening the cover 26.

It will be apparent from the foregoing description that in order to feed an oversized envelope into the mailing machine, such as the envelope E shown in FIG. 7, the operator need only raise the side guide 44' from the its lowest position resting on the feed deck 14 to the elevated position as limited by the arcuate slot 98, and the envelope E can easily be passed under the side guide 44'. The side guide 44' and the support means in 30' are held in the elevated position merely by adjustment of the not 94 on the stub shaft 92 to provide sufficient friction to prevent the side guide 44' and the support means 30' from dropping back onto the feed deck without being pushed.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

We claim:

1. In combination with a mailing machine having a hopper for holding a stack of envelopes to fed through and processed in the mailing machine, a feed deck for supporting said stack, a feeding means mounted in said feed deck for separating the bottom envelope of said stack feeding said envelope into said mailing machine, and a registration wall against which said feeding means urges the first side edge of said bottom envelope during said separating and feeding, an envelope side guide for engaging the lower side edge of said envelope during said separating and feeding of said envelopes for maintaining proper alignment of said envelopes during said separating and feeding, said side guide comprising:

A. an elongate support means having one end thereof mounted on said mailing machine positioned adjacent said registration wall and in overlying relationship with said feed deck, B. means permitting said support means to be manually extendable and retractable in a direction substantially perpendicular to the direction of feed of envelopes along said feed deck, C. guide means mounted on said support means adjacent the end thereof opposite to said end thereof that is mounted on said mailing machine, and D. means permitting said guide means to be moved from a first position in which said guide means is substantially resting on said feed deck adjacent said second side edge of said bottom envelope and a second position in which said guide means is spaced above said feed deck a distance sufficient to permit an oversized envelope to pass beneath said guide means, whereby said side guide prevents envelopes from skewing out of the proper orientation for feeding through said mailing machine.

2. An envelope side guide as set forth in claim 1 wherein said means permitting said elongate support means to be extendable and retractable comprises said support means being formed as a plurality of elongate support elements which are formed to fit telescopically one within another, one of said support elements being connected to said mailing machine frame.

3. An envelope side guide as set forth in claim 2 wherein

A. said means permitting said guide means to be moved between said first and second positions comprises said one support element being rigidly connected to said mailing machine frame, and B. means connecting said guide means to said opposite end of said support means for limited vertical movement of said guide means relative to said feed deck.

4. An envelope side guide as set forth in claim 3 wherein said means connecting said guide means to said opposite end of said support means comprises A. a bracket fixedly mounted on said opposite end of said support means, said bracket having vertically spaced latching means, B. a generally rectangular housing, said housing having a generally rectangular guide plate connected thereto in a position to contact the second side edges of said envelopes in said stack, C. a spring loaded latching element movably mounted within said housing between horizontally spaced positions in which said latching element is engaged with said latching means in said bracket, and D. means operatively connecting said latching element with said bracket for limited vertical movement between said vertically spaced latching means when said latching element is disengaged from said vertically spaced latching means in said bracket.

5. An envelope side guide as set forth in claim 3 wherein said means permitting said guide means to be moved between said first and second positions comprises said one support element being pivotally connected to said frame such that said guide means can be raised and lowered between said first position and second positions.

6. An envelope side guide as set forth in claim 5 wherein said pivotal connection between said one support element and said mailing machine frame includes means limiting the vertical pivotal arc of movement of said support means.

* * * * *